United States Patent [19]

Biedacha et al.

[11] 4,129,169

[45] Dec. 12, 1978

[54] APPARATUS FOR MAKING SHELLS FROM THERMOSETTING LIQUID COMPOUNDS

[75] Inventors: Roman Biedacha; Wladyslaw Kurdziel; Janusz Kaczor, all of Cracow; Adam Smeder, Wegrzce; Jacek Kolaczkowski, Cracow; Tadeusz Olszowski, Cracow; Adam Nawrocki, Cracow; Janina Rzeszut, Cracow, all of Poland

[73] Assignee: Przedsicbiorstwo Projektowania I Realizacji Inwestycji przemyslu Maszynowego "Bipromasz", Instytut Odlewnictwa, Cracow, Poland

[21] Appl. No.: 813,428

[22] Filed: Jul. 6, 1977

Related U.S. Application Data

[62] Division of Ser. No. 739,535, Nov. 3, 1976.

[30] Foreign Application Priority Data

Nov. 10, 1975 [PL] Poland ..... 184620

[51] Int. Cl.[2] ..... B22C 13/08

[52] U.S. Cl. ..... 164/166; 164/21; 164/43

[58] Field of Search ..... 164/12, 15, 16, 17, 164/18, 19, 20, 21, 22, 165, 166, 159

[56] References Cited

FOREIGN PATENT DOCUMENTS

| | | | |
|---|---|---|---|
| 1023195 | 1/1958 | Fed. Rep. of Germany | 164/21 |
| 128977 | 5/1959 | U.S.S.R. | 164/21 |

*Primary Examiner*—Francis S. Husar
*Assistant Examiner*—K. Y. Lin
*Attorney, Agent, or Firm*—Haseltine, Lake & Waters

[57] ABSTRACT

Apparatus for making shells from thermosetting liquid compounds in which at a first station, a travelling and heated permanent metal mould becomes filled with a thermosetting liquid compound. The mould is then moved to a second station where it is held until a shell wall of desired thickness is obtained. Thereafter, the mould is transferred to a further station where excess thermosetting compound is recovered and dispensed to an accumulative mixer to be used again. Subsequently, the metal mould is passed to a final station where it is opened and the ready shell removed. The apparatus comprises said and liquid constituent containers, a sand feeder and two mixers, namely, a basic mixer and an accumulative mixer. The apparatus is provided with a unit for proportioning the liquid constituents and a delivery unit to force the compound into the mould.

2 Claims, 5 Drawing Figures

APPARATUS FOR MAKING SHELLS FROM THERMOSETTING LIQUID COMPOUNDS

CROSS-RELATED APPLICATION

This application is a division of Ser. No. 739,535 filed Nov. 3, 1976.

Field of the Invention

This invention relates to apparatus for making of shells from thermosetting liquid compounds, especially casting shells.

Prior Art

As to the hitherto known methods for manufacturing of shells from the thermosetting compounds, the following features can be distinguished.

According to the "Shalc'o" method: grains of the sand being poured into the hot permanent mould, are enveloped with a film of resin, which in presence of the heat from the mould walls causes binding of the sand grains, thus forming the shell. Excess sand is poured out from the mould. Preparation of the enveloped sand grains requires sophisticated procedures to be carried out in special plants.

The Shalc'o method provides for keeping the metal mould in one station during the complete manufacturing cycle. The enveloped sand grains are poured into the metal mould, and then with the ready shell being emptied, it becomes turned through 180°. The equipment for using this method consists of the heating unit to maintain the metal mould temperature as required, the vice to close the mould components, and the sand container to feed the mould cavities and to receive the sand recovered from the shell interior.

The ready shell is taken out on opening the permanent metal mould.

The "floterm" method, as developed in the Foundry Practice Institute of Cracow, also provides for keeping the heated metal mould in one station during the complete manufacturing cycle.

According to the "floterm" method, as the initial material for production of shells, thermosetting liquid compounds are used, consisting of quartz sand and the liquid constituent which contains the thermoplastic sintering substances.

The shell is obtained on completion of filling of the hot metal mould cavities.

The shell wall thickness is determined by the time of heating of the metal mould content. The requisite equipment comprises the unit for preparation of the thermosetting liquid compound with its sand and liquid constituent feeders which use a piston pump with two non-return ball check valves, the paddle-worm mixer and the accumulative mixer. The shell making unit is provided with equipment for filling the metal mould cavities which operates as a feeding screw.

For all the above equipment, the basic process operations viz. filling the metal mould with sand, waiting until the shell of appropriate wall thickness is formed, receiving the ready shell and preparing of the metal mould for the next cycle, are effected at one and the same station.

A disadvantage common to the said methods is their low productivity which results from keeping the metal mould at one station during all the process operations, this being considered indispensable to produce one shell or a set of them conforming to the overall mould dimensions.

As to the hitherto used experimental equipment for the "floterm" method, its disadvantage consists in the insufficient pressures exerted on the thermosetting liquid compounds inside the metal mould by the feeding screw, especially in the case of larger height dimensions and more sophisticated shapes, thus resulting in an excessive number of rejects and poor quality of the shells.

Another shortcoming of the said equipment is sticking of the ball valves in the liquid constituents feeder, which leads to improper proportions between the sand quantity in the mixer and the liquid constituent volume. This shortcoming is the reason for an increasing number of rejects and low productivity.

SUMMARY OF THE INVENTION

This invention has been aimed at developing a method for making shells from thermosetting liquid compounds and at designing appropriate equipment for embodying the method so as to ensure higher productivity of the units and improved quality of the shells.

To achieve this, a method has been designed where the metal moulds are successively passed over all the stations during the shell manufacturing process associated equipment has been developed, comprising the unit to feed the liquid constituents and another unit for forcing the thermosetting liquid compound into the permanent metal mould.

The essence of the invention lies in making the shells from thermosetting liquid compounds in heated metal moulds, the said compounds being obtained from a set of containers and feeders or poportioners, viz. the sand container, and feeder and the liquid constituents container and feeder, and the mixers namely, the basic mixer and the accumulative mixer. Then thermosetting liquid compound becomes forced at the first station into the metal mould by means of a forcing unit.

The filled mould is handed over to the next station to remain there until a shell wall of appropriate thickness is formed; subsequently, the metal mould is passed over to another station to recover from the shell interior — by means of a through-blower — the residual compound and to dispose of it in the accumulative mixer, the latter being associated with the basic mixer, which is supplied from the containers and the feeder with the constituents to prepare the thermosetting liquid compound.

In the meantime, the travelling metal mould reaches the last station to be opened there for removal of the ready shell and for preparation of the next production cycle.

The accumulative mixer is located under the travelling metal mould in such a position, that the thermosetting liquid compound is received in the forcing unit from the end of the accumulative mixer, and the through-blower returns the recovered compound directly to the accumulative mixer in its beginning point.

The travelling mould interior is provided with an insulating liner, most advantageously made from thin sheet metal so as to leave an air chamber between the mould wall and the liner external surface.

The equipment for making the shells from the thermosetting liquid compounds and which comprises the sand container and feeder, the basic mixer and the accumulative mixer, is provided with a liquid constituents proportioning unit and a unit to force the thermosetting liquid compound into the mould. The liquid constituents proportioner is composed of a moving container immersed in the constituent, a fixed and leakproof cover, and a passage to dispose the constituents portion.

The portion size is adjustable by changing the distance between the cover and the container.

The forcing unit has a suction passage, an overflow passage, a moving container with a moving bottom, two servo-motors, a body with conical part, a damper shaft whereupon a cam is mounted to hold the head against the metal mould via a spring element, and a damper to open or shut off the delivery passage.

With the design according to this invention, the following advantages have been attained:

- increased productivity as compared with the hitherto used methods, due to distribution of the process operations among individual stations;
- (in the case of four stations, the productivity rises about four times);
- reduced number of rejects owing to precise filling of the core box or mould cavities with a unit which forces the compound under controlled pressure, depending upon the shell shape;
- due to use of a valveless proportioner, jamming of the distribution elements in the liquid constituents feeder may be avoided;
- easy changeover to other products by removing the free travelling metal moulds from the equipment, and replacing them with moulds having cavities of different shape.

BRIEF DESCRIPTION

An embodiment example of the invention can be seen from the drawings where

DETAILED DESCRIPTION

Figure 1:
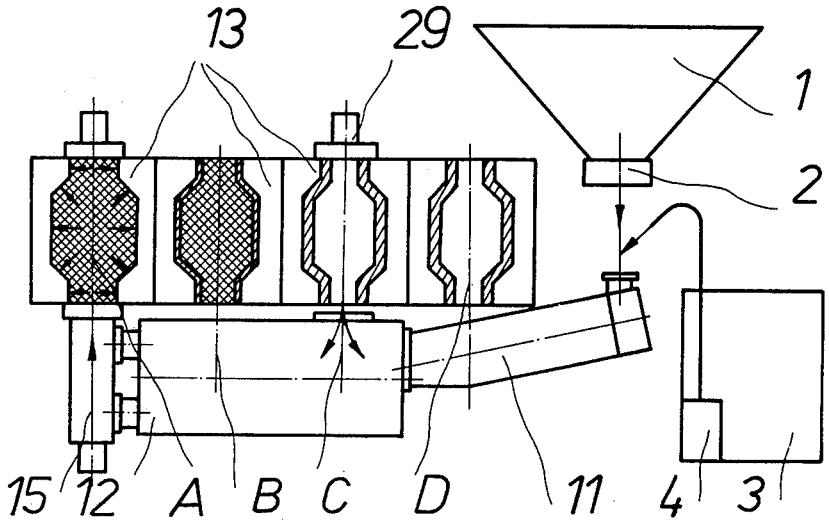
FIG. 1 shows a schematic layout of the basic equipment units and the process stations in plan.
Figure 2:
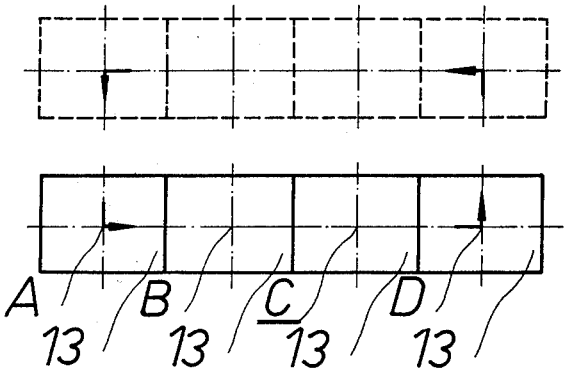
FIG. 2 is a vertical projection of the process stations arrangement.

According to FIGS. 1 and 2, production of shells from a thermosetting liquid compound, is effected at four stations A, B, C and D.

At the station A, the thermosetting liquid compound is forced into the heated metal mould 13 by means of a forcing and delivery unit 15, and then the metal mould 13 is moved to the station B where it remains till a shell wall of the desired thickness is formed.

Next the mould 13 is moved to the station C and emptied of the compound residue by means of a through-blower 29. This residue is returned for reuse to an accumulative mixer 12.

Then, the metal mould 13 complete with the empty shell is moved to the station D to be opened there, the shell being removed and the mould prepared for the next production cycle starting at the station A.

Preparation of the casting compound is carried out by means of a sand container 1, a liquid constituent container 3, a sand feeder 2 and a unit 4 to proportion the liquid constituents.

The compound ingredients are mixed, in appropriate proportions, in the basic mixer 11, and are then transferred to the accumulative mixer 12 to be mixed there with the thermosetting liquid compound remaining from the previous cycle. From the accumulative mixer 12, the compound is fed to the forcing and delivery unit 15 at a station A.

Figure 3:
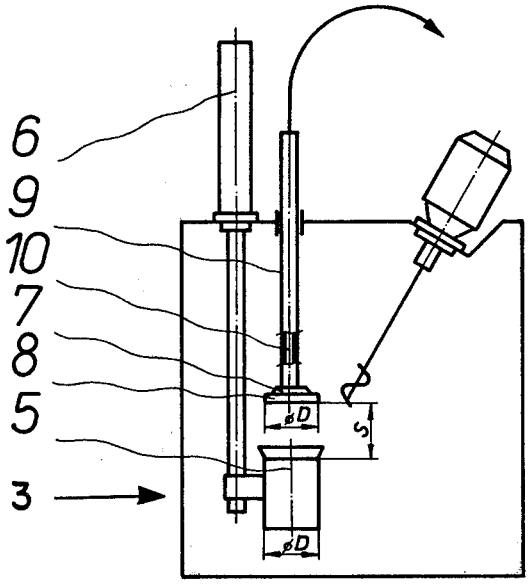
FIG. 3 is a schematic drawing of the liquid constituent proportioner.
Figure 5:
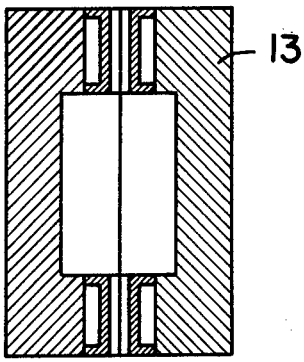
FIG. 5 is an axial section of the metal mould or core box.

FIG. 3 shows the schematic drawing of the liquid constituent proportioner 4'. This unit consists of a container 5 immersed in the liquid constituent, the container 3 being lifted or lowered with a servo-motor 6.

The proportioner unit 4 comprises also a cover 7, with a seal 8, of the container 5 of diameter D, and a piston rod 9 with a passage 10.

The liquid constituent batch, whose size is determined by the distance S between the container 5 and the cover 7, is dispensed to the basic mixer 11 via the passage 10 during the power stroke of the servo-motor 6 piston rod.

Figure 4:
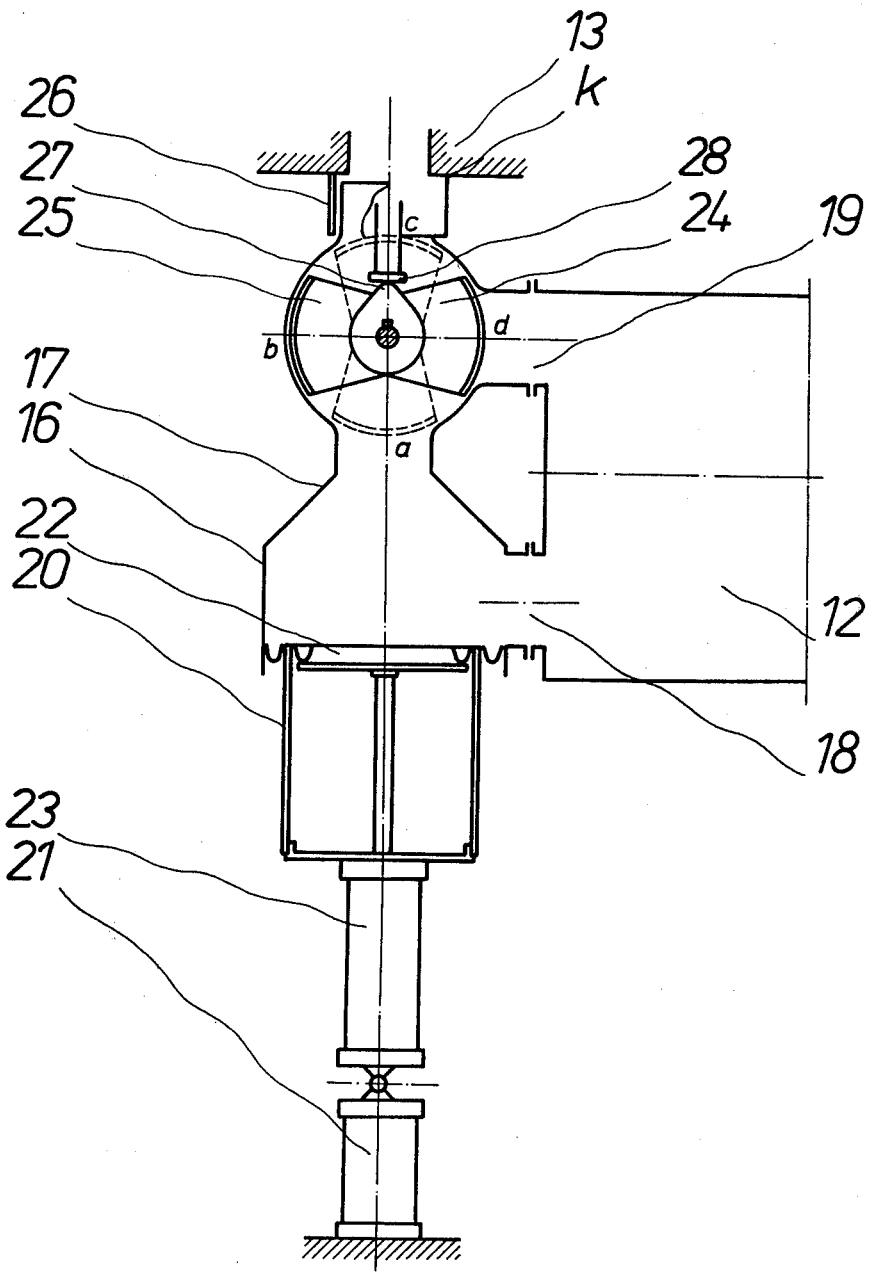
FIG. 4 is a schematic drawing of the unit to force the thermosetting liquid compound into the metal moulds.

FIG. 4 is a schematic drawing of the unit 15 to force and deliver the thermosetting compound.

The unit 15 has a body 16 provided with a conical part 17, a suction passage 18 and an overflow passage 19 as well as a moving container 20 operated with a servo-motor piston rod 23. Two dampers 24 and 25 are provided and to the shaft of the damper 24, cam 27 is permanently secured and holds a head 26 against the face K of the mould 13 via a spring element 28.

The container 20 becomes filled with the thermosetting liquid compound via the passage 18 when it is in its lower position with the damper 25 set in the position a and a sliding bottom 22 of the container 20 set in its lowermost position.

Forcing of the compound into the passage of the metal mould 13 is initiated when the container 20 is lifted, by means of the piston rod of the servo-motor 21, into a position where the upper edge of the container 20 adjoins the conical part 17 of the body 16, the damper 25 being deflected to the position b. Before the container 20 is again lowered, the damper 25 returns to its former position a.

In the position c of the damper 24, the thermosetting liquid compound is despensed via the passage 19, into the accumulative mixer 12, the pressure of the head 26 against the face K of the metal mould 13 being released at an appropriate time. In the position d of the damper 24, the thermosetting liquid compound is prevented from reaching the accumulative mixer 12.

We claim:

1. Apparatus for making shells from liquid thermosetting compounds comprising:
   - (a) a mould;
   - (b) a sand container;
   - (c) a liquid constituent container for a liquid constituent which includes a thermosetting compound;
   - (d) means operatively coupled with said sand container and said liquid constituent container for forming a molding composition from the sand and the liquid constituent in said containers, said means including a first mixing unit receiving sand and liquid constituent from said containers, a second mixing unit connected with an outlet end of said first mixing unit and arranged to receive excess thermosetting compound from said mould, a sand feeder for feeding sand from said sand container into said mixing unit, and a proportioner unit for proportioning the liquid constituent to be combined with the sand in said first mixing unit, said proportioner unit comprising a movable container body in said liquid constituent container for dispensing a quantity of the liquid constituent into said first mixing unit in response to displacement of said container body, and a fixedly mounted cover having an aperture which communicates with said first mixing unit arranged to cooperate with said container body in dispensing the liquid constituent into said first mixing unit, the liquid constituent being forced through said aperture and into said first mixing unit in response to displacement of said container body towards said cover, and the quantity of the liquid constituent dispensed into said first mixing unit being dependent upon the initial spacing between said container body and said cover; and (e) a delivery unit positioned for introducing the molding composition into said mould, said delivery unit comprising a housing having a first passage which communicates with said second mixing unit to permit introduction of the molding composition into said housing and a second passage which also communicates with said second mixing unit to permit return of excess molding composition into said second mixing unit, said delivery unit including a conical member interiorly of said housing and a delivery head for the introduction of the casting composition into said mould, said delivery unit further comprising a movable container member having an open end which faces said conical member, said container member being movable from a first position in which said open end is spaced from said conical member to a second position in which said open end abuts said conical member, said container member having a sliding bottom movable from a position adjacent said open end to a position remote therefrom, said delivery unit also comprising a motor unit for displacing said container member and said sliding bottom thereof, a first damper movable between an open position in which said delivery head communicates with said open end of said container member and a closed position in which said delivery head is closed off from said open end of said container member, and a second damper having an open position in which said second passage communicates with said open end of said container member and a closed position in which said second passage is closed off from said open end of said container member, said second damper having a shaft, said delivery unit comprising a cam secured to said shaft, and a biasing element interposed between said cam and said delivery head and operative for biasing said delivery head into engagement with said mould, said container member being filled with the molding composition when said container member is in said first position and said sliding bottom is remote from said open end of said container member, and the molding composition being delivered into said mould via said delivery head by moving said container member to said second position, moving said first damper to said open position thereof and displacing said sliding bottom to a position adjacent said open end of said container member.

2. Apparatus as defined in claim 1, wherein said means for forming the molding composition comprises a tube connecting said cover and said first mixing unit and said cover is provided with a seal so as to be substantially leakproof, said first passage being a suction passage, and said biasing element being a spring element.

* * * * *